US009246259B2

(12) United States Patent
Sakamoto

(10) Patent No.: US 9,246,259 B2
(45) Date of Patent: Jan. 26, 2016

(54) JOINT CONNECTOR

(71) Applicant: YAZAKI CORPORATION, Minato-ku, Tokyo (JP)

(72) Inventor: Nobuyuki Sakamoto, Makinohara (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 14/455,993

(22) Filed: Aug. 11, 2014

(65) Prior Publication Data

US 2014/0349524 A1 Nov. 27, 2014

Related U.S. Application Data

(63) Continuation of application No. PCT/JP2012/008249, filed on Dec. 25, 2012.

(30) Foreign Application Priority Data

Feb. 16, 2012 (JP) ..... 2012-031307

(51) Int. Cl.
*H01R 13/514* (2006.01)
*H01R 13/422* (2006.01)
(Continued)

(52) U.S. Cl.
CPC ..... *H01R 13/514* (2013.01); *H01R 13/4226* (2013.01); *H01R 31/08* (2013.01); *H01R 4/185* (2013.01); *H01R 13/28* (2013.01); *H01R 2201/26* (2013.01)

(58) Field of Classification Search
CPC ..... H01R 13/28
USPC ..... 439/721, 723, 724
See application file for complete search history.

(56) References Cited

U.S. PATENT DOCUMENTS 4,322,120 A * 3/1982 Rilling ..... H01R 12/716 439/631
4,664,460 A * 5/1987 Vandame ..... H01R 13/4223 439/595

(Continued)

FOREIGN PATENT DOCUMENTS

DE 8520470 U1 9/1985
JP H06-36268 U 5/1994

(Continued)

OTHER PUBLICATIONS

Japanese office action issued on Sep. 8, 2015 in the counterpart Japanese patent application.

(Continued)

*Primary Examiner* — Ross Gushi
(74) *Attorney, Agent, or Firm* — Marvin A. Motsenbocker; Mots Law, PLLC

(57) ABSTRACT

A joint connector includes a housing that includes terminal chambers. At least two neighboring joint terminals are housed in terminal chambers neighboring among the terminal chambers, respectively. Each of the neighboring joint terminals includes a wire-crimping portion, a terminal body housed in a terminal chamber among the plurality of terminal chambers, and a pair of first and second contact portions, respectively. The first contact portion of one of the neighboring joint terminals is electrically contacted with the second contact portion of another of the neighboring joint terminals. The connector housing is provided with pairs of elastically deformable tabs, each of the pairs including two opposed deformable tabs and provided in each of the plurality of the terminal chambers. The opposed deformable tabs contact with sidewalls of the terminal body of the each of the neighboring joint terminals, respectively, by an elastic restoration behavior of the opposed deformable tabs.

18 Claims, 7 Drawing Sheets

(51) Int. Cl.

| | |
|---|---|
| ***H01R 31/08*** | (2006.01) |
| *H01R 4/18* | (2006.01) |
| *H01R 13/28* | (2006.01) |

(56) References Cited

U.S. PATENT DOCUMENTS

| | | | | |
|---|---|---|---|---|
| 5,009,615 | A * | 4/1991 | Mobley | H01R 13/4223 439/594 |
| 5,980,318 | A * | 11/1999 | Morello | H01R 13/4226 439/595 |
| 6,319,071 | B1 * | 11/2001 | Sato | H01R 4/185 439/701 |
| 6,386,925 | B1 * | 5/2002 | Sato | H01R 13/41 439/701 |
| 6,406,335 | B2 * | 6/2002 | Sato | H01R 13/514 439/701 |
| 6,511,351 | B2 * | 1/2003 | Sato | H01R 9/2458 439/709 |
| 6,573,453 | B2 * | 6/2003 | Takada | B60R 16/0207 174/72 A |
| 6,634,101 | B2 * | 10/2003 | Sato | H01R 13/506 29/827 |
| 7,179,136 | B1 * | 2/2007 | Morello | H01R 13/4223 439/140 |
| 7,381,091 | B2 * | 6/2008 | Menez | H01R 13/4226 439/386 |
| 7,425,160 | B2 * | 9/2008 | Lee | H01R 13/514 439/701 |
| 7,658,645 | B1 * | 2/2010 | Morello | H01R 13/4223 439/595 |
| 8,747,168 | B2 * | 6/2014 | Kida | H01R 13/506 439/701 |
| 9,028,277 | B2 * | 5/2015 | Nemoto | H01R 13/4226 439/595 |
| 9,054,430 | B2 * | 6/2015 | Sakamoto | H01R 4/16 |
| 9,088,118 | B2 * | 7/2015 | Morikawa | H01R 13/28 |
| 2002/0006752 | A1 * | 1/2002 | Sato | H01R 13/514 439/701 |
| 2002/0115354 | A1 * | 8/2002 | Sato | H01R 13/533 439/701 |
| 2007/0066135 | A1 * | 3/2007 | Menez | H01R 13/4226 439/595 |
| 2013/0337696 | A1 * | 12/2013 | Sakamoto | H01R 24/28 439/658 |
| 2014/0011394 | A1 * | 1/2014 | Shinmi | H01R 13/5804 439/471 |
| 2014/0349510 | A1 * | 11/2014 | Sakamoto | H01R 13/428 439/357 |
| 2014/0349521 | A1 * | 11/2014 | Sakamoto | H01R 31/08 439/626 |
| 2014/0349524 | A1 * | 11/2014 | Sakamoto | H01R 13/514 439/701 |
| 2015/0087183 | A1 * | 3/2015 | Sakamoto | H01R 13/4223 439/553 |
| 2015/0104981 | A1 * | 4/2015 | Sakamoto | H01R 13/4223 439/682 |
| 2015/0111439 | A1 * | 4/2015 | Shinmi | H01R 13/11 439/796 |
| 2015/0111444 | A1 * | 4/2015 | Sakamoto | H01R 13/2414 439/888 |

FOREIGN PATENT DOCUMENTS

| | | | |
|---|---|---|---|
| JP | H10-233254 | A | 9/1998 |
| JP | 2002-033154 | A | 1/2002 |
| JP | 2007-287611 | A | 11/2007 |
| JP | 2009-211976 | A | 9/2009 |
| WO | 2009/110639 | A2 | 9/2009 |
| WO | 2009110639 | A3 | 9/2009 |

OTHER PUBLICATIONS

Korean office action issued on Sep. 10, 2015 in the counterpart Korean patent application.

Chinese office action issued on Nov. 2, 2015 in the counterpart Chinese patent application.

Japanese office action issued on Nov. 17, 2015 in the counterpart Japanese patent application.

* cited by examiner

JOINT CONNECTOR

CROSS-REFERENCE TO RELATED APPLICATIONS

The present application is a Continuation Application of PCT International Application No. PCT/JP2012/008249 (filed on Dec. 25, 2012), which is based upon and claims the benefit of priority from Japanese Patent Application No. 2012-31307 (filed on Feb. 16, 2012), the entire contents of which are incorporated herein with reference.

BACKGROUND OF THE INVENTION

1. Technical Field

The present invention relates to a joint connector for electrically connecting plural joint terminals inserted into a connector housing with each other.

2. Background Art

A Patent Literature 1 (Japanese Utility Model Application Laid-Open No. H6-36268) discloses one of prior art joint connectors. As shown in FIGS. 8 and 9, the joint connector 50 includes a connector housing 51, and plural joint terminals 60 housed in the connector housing 51. Note that only one of the joint terminals 60 is shown in FIG. 8, and others of them are not shown in FIG. 8.

The connector housing 51 is provided with plural terminal chambers 53 segmented by partitions 52. A slit 54 is formed on each of the partitions 52.

The joint terminal 60 includes a wire-crimping portion 61 with which a wire W is connected, a terminal body 62 integrally provided with the wire-crimping portion 61, and a pair of contact tabs 63 integrally provided with the terminal body 62. The terminal body 62 is mainly constituted of a bottom wall 62*a* and a pair of sidewalls 62*b*. The terminal body 62 is inserted into the terminal chamber 53 and thereby housed in the terminal chamber 53. The contact tabs 63 are bent laterally outward from upper ends of the sidewalls 62*b*, respectively.

The two contact tabs 63 of the joint terminal 60 are located in the adjacent slits 54, respectively. In a slit 54, a one-side contact tab 63 of a joint terminal 60 contacts with an other-side contact tab 63 of a next joint terminal 60. The contact tabs 63 in the slit 54 are overlapped so as to contact with each other. Therefore, the neighboring joint terminals 60 are electrically contacted with each other.

According to the prior art joint connector 50, the neighboring joint terminals 60 are directly contacts with each other, electrically, so that no additional component is needed for connecting the neighboring joint terminals 60, such as an interposed conductive member and components associated with the conductive member.

SUMMARY OF INVENTION

According to the prior art joint connector 50, the terminal body 62 of the joint terminal 60 is inserted into the terminal chamber 53 of the housing 51, so that a clearance must be needed between surfaces of the partitions 52 and outer face of the sidewalls 62*b* to enable the terminal body 62 of being inserted into the terminal chamber 53.

However, if such a clearance is provided between the terminal body 62 and the partitions 52, the joint terminal 60 may be vibrated in the terminal chamber 53 under a vibrational environment. The contact tabs 63 of the neighboring joint terminals 60 slides while contacted with each other, so that a contact resistance may increase. In the worst case, the neighboring joint terminals 60 may lose electrical conductivity.

In addition, the connector housing 51 is generally made of a material (e.g. resin) different from that (e.g. metal) of the joint terminals 60. Namely, the connector housing 51 generally has a coefficient of thermal expansion (CTE) different from that of the joint terminals 60. The terminal body 62 may changes its position in the terminal chamber 53 due to temperature variations, so that a contact resistance may increase.

An object of the present invention provides a joint connector that can sufficiently restrict an increase of a contact resistance to be generated by vibrations and temperature variations.

An aspect of the present invention provides a joint connector that includes: a housing that includes a plurality of terminal chambers segmented by a plurality of partitions; and at least two neighboring joint terminals that are housed in terminal chambers neighboring among the plurality of terminal chambers, respectively, wherein each of the neighboring joint terminals includes a wire-crimping portion with which a wire is connected, a terminal body housed in a terminal chamber among the plurality of terminal chambers, and a pair of first and second contact portions laterally extended outward from both sides of the terminal body, respectively, the first contact portion of one of the neighboring joint terminals is electrically contacted with the second contact portion of another of the neighboring joint terminals in a slit among the plurality of slits that is located between the neighboring joint terminals, the connector housing is provided with pairs of elastically deformable tabs, each of the pairs including two opposed deformable tabs and provided in each of the plurality of the terminal chambers, and the opposed deformable tabs contact with sidewalls of the terminal body of the each of the neighboring joint terminals, respectively, by an elastic restoration behavior of the opposed deformable tabs.

According to the aspect, the joint terminal(s) can be prevented from being vibrated when the joint connector is located under a vibrational environment, because the joint terminal is held in the terminal chamber by the deformable tabs contacting with the sidewalls of the joint terminal. In addition, the joint terminal(s) can be located at a constant position in the terminal chamber when clearances between the partitions and the sidewalls of the terminal body change due to temperature variations, because the changes of the clearances can be compensated by the elastic restoration behavior of the deformable tabs. Therefore, the first contact portion and the second contact portion of the neighboring joint terminals can be stably contacted with each other. As a result, an increase of a contact resistance to be generated by vibrations and temperature variations can be sufficiently restricted.

Here, it is preferable that the opposed deformable tabs are formed integrally with neighboring partitions among the plurality of partitions so as to have a cantilever structure, respectively, and free ends of the opposed deformable tabs are contacted with the sidewalls, respectively.

In addition, it is also preferable that the second contact portion includes an upper contact tab and an lower contact tab that are located parallel and a gap is formed between the upper contact tab and the lower contact tab, and the first contact portion of one of the neighboring joint terminals is configured to be wedged into the gap between the upper contact tab and the lower contact tab of the second contact portion of the other of the neighboring joint terminals.

DESCRIPTION OF EMBODIMENTS

An embodiment of a joint connector will be explained with reference to FIGS. 1 to 7.

Figure 1:
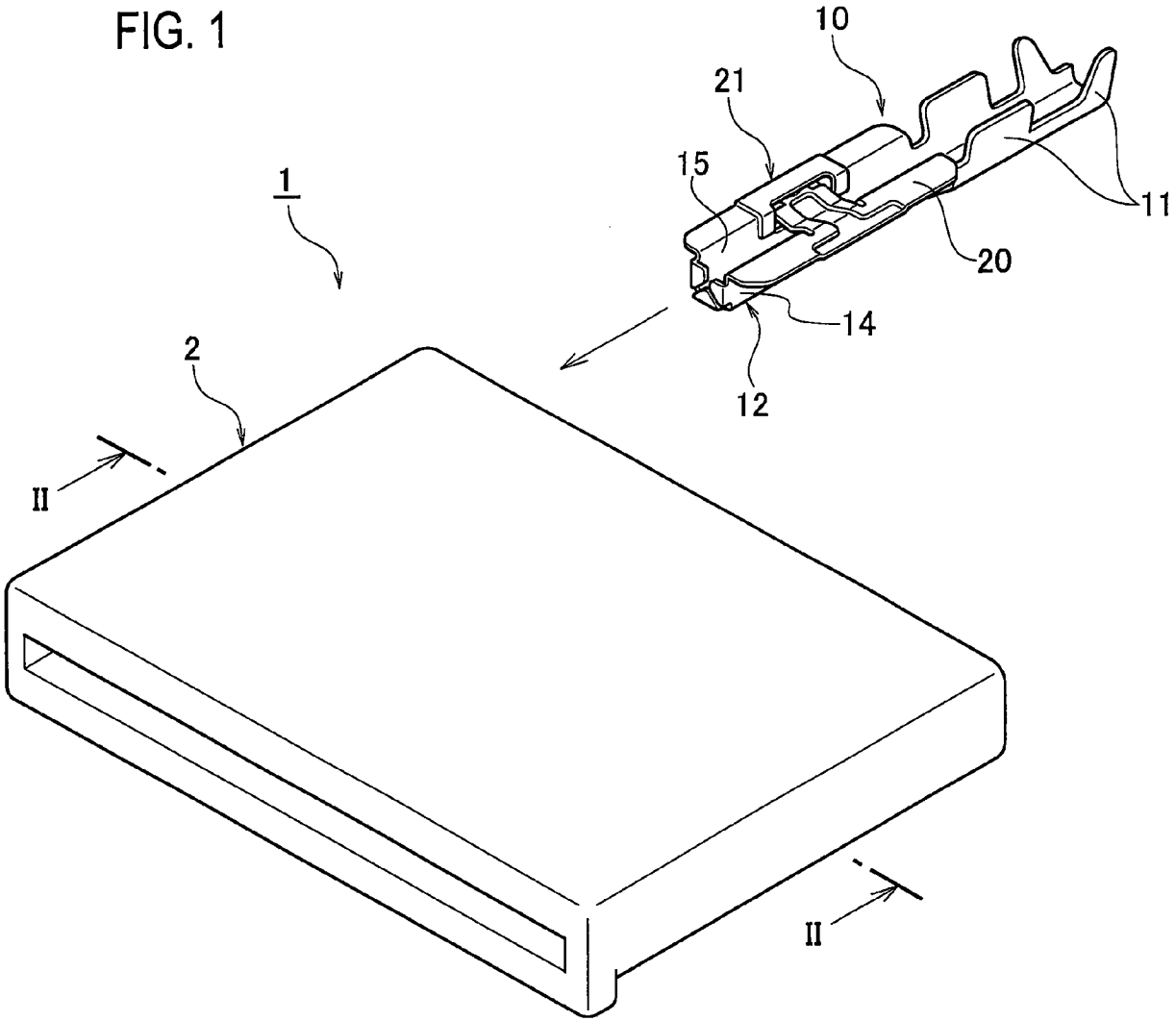
FIG. 1 is a perspective view of a joint connector according to an embodiment.

The joint connector 1 includes a non-conductive housing 2, and plural joint terminals 10 housed in the connector housing 2. Note that only one of the joint terminals 10 is shown in FIG. 1 and others of them are not shown in FIG. 1.

The connector housing 2 is provided with plural terminal chambers 4 segmented by partitions 3. A slit 5 is formed on each of the partitions 3. The neighboring terminal chambers 4 are communicated with each other via the slit 5. Lances 6 are integrally formed on the connector housing. The lances 6 are associated with the terminal chambers 4, respectively. The lances 6 are formed as barbed tabs and have pawls protruded from bottoms of the terminal chambers 4, respectively. Each of the lance 6 locks the joint terminal 10 had been inserted into the terminal chamber 4 in order to prevent the joint terminal 10 from being pulled out from the terminal chamber 4.

Figure 5:
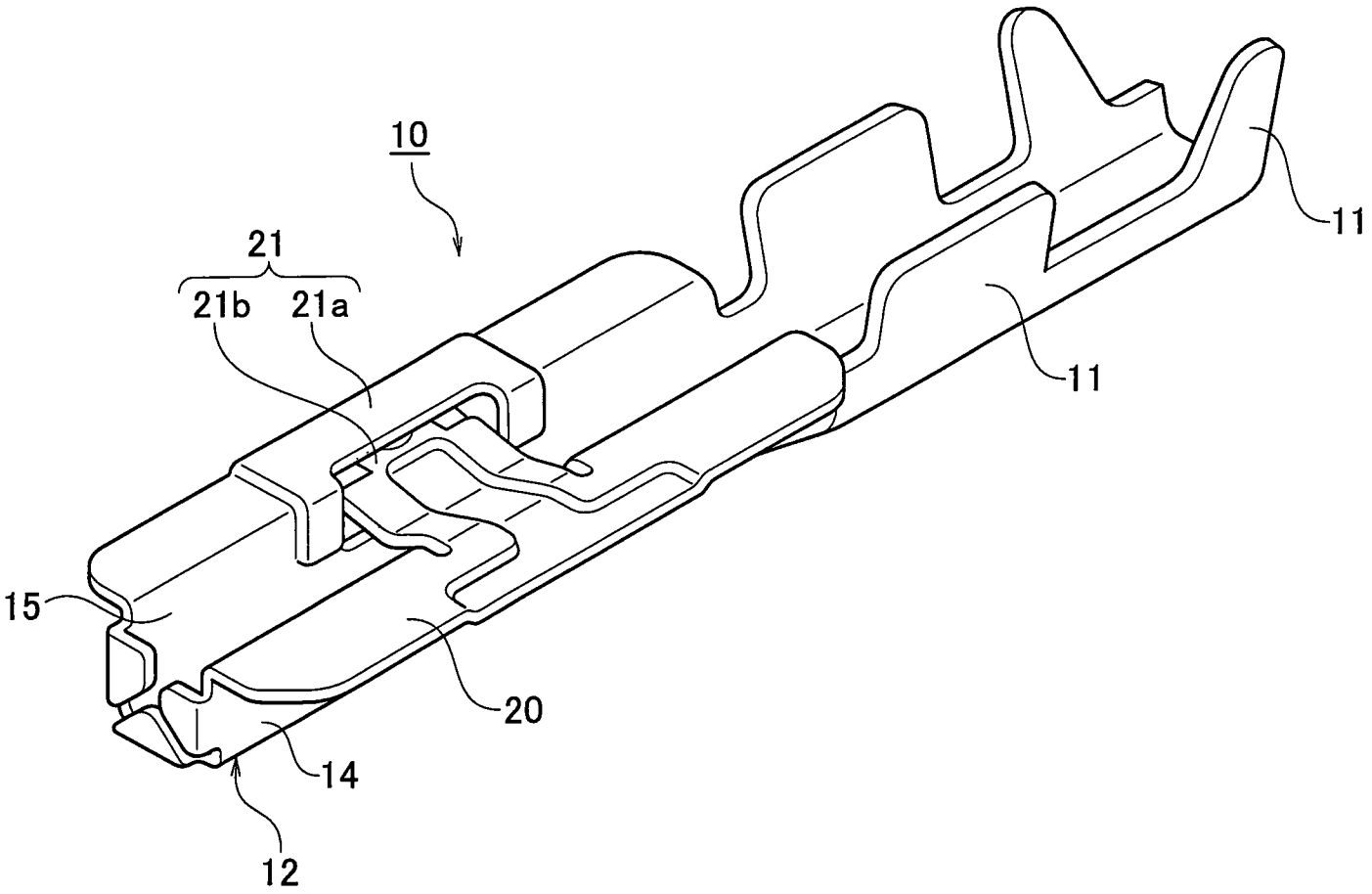
FIG. 5 is a perspective view of a joint terminal in the embodiment.
Figure 6:
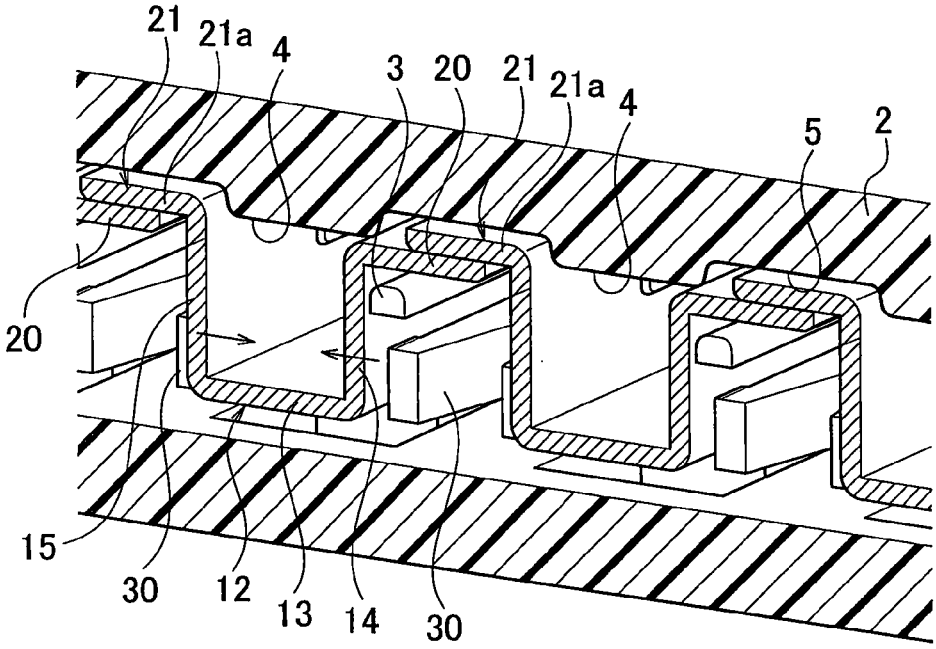
FIG. 6 is an enlarged perspective cross-sectional view of a main portion of the joint connector.
Figure 7:
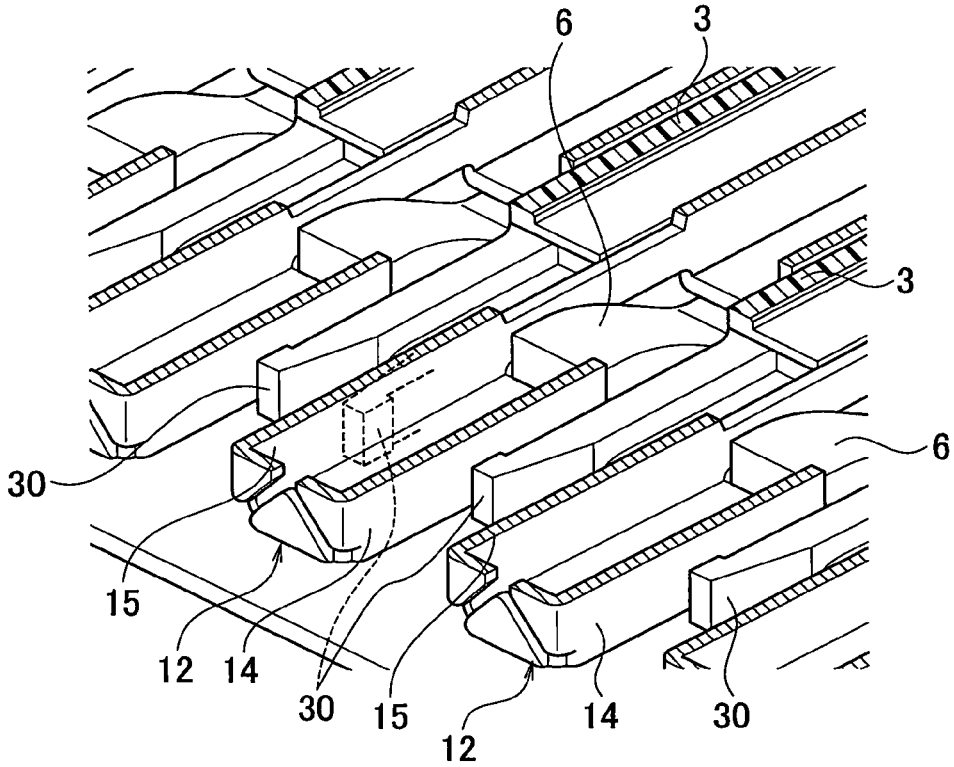
FIG. 7 is an enlarged perspective cross-sectional view showing the joint connector (a lateral cross-sectional plane)
Figure 8:
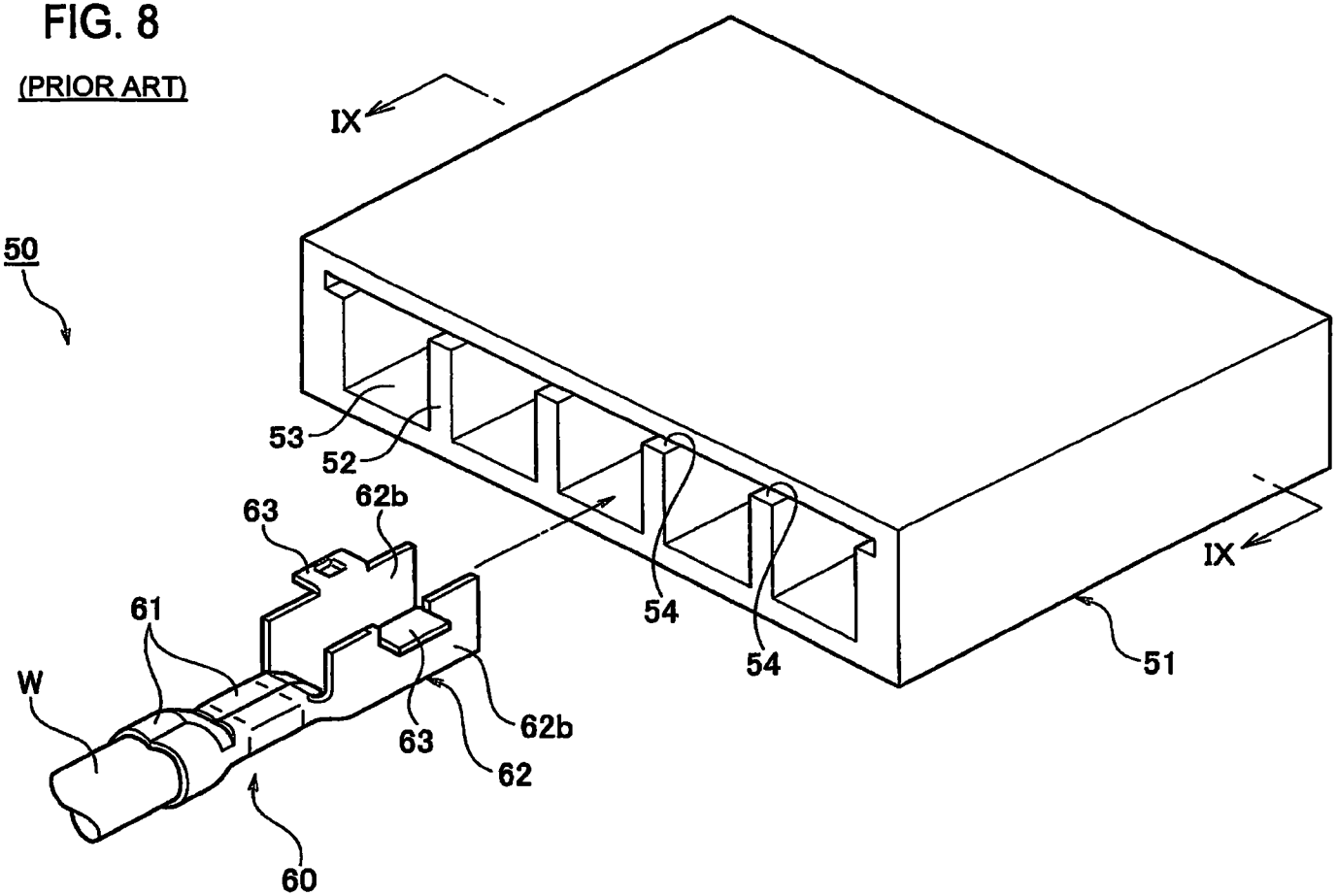
FIG. 8 (PRIOR ART)
FIG. 8 is a perspective view of a joint connector according to a prior art.
Figure 9:
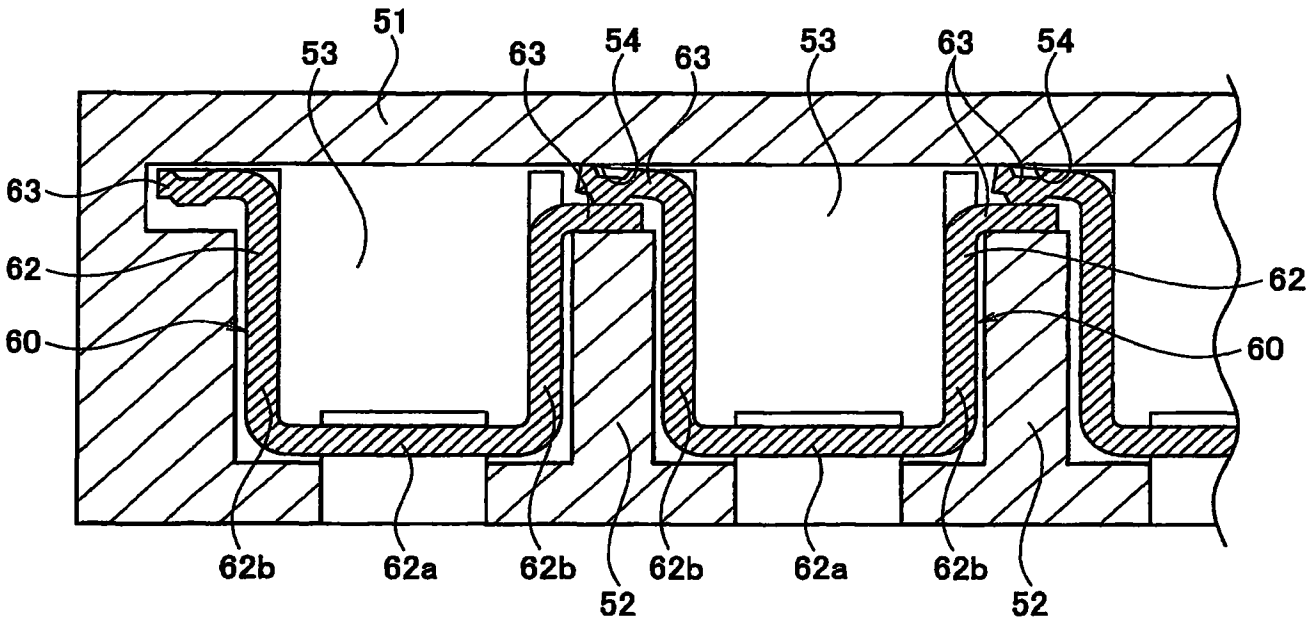
FIG. 9 (PRIOR ART)
FIG. 9 is an enlarged cross-sectional view showing a main portion of the joint connector according to a prior art.

As shown in FIG. 5, the joint terminal 10 is formed by bending a conductive (metal) plate having a given dimension. The joint terminal 10 includes a wire-crimping portion 11 to which a wire is to be connected, a terminal body 12 integrally provided with the wire-crimping portion 11, and a pair of a first contact portion 20 and a second contact portion 21 that are integrally provided with the terminal body 12.

The terminal body 12 is mainly constituted of a bottom wall 13, and a pair of sidewalls 14 and 15. The terminal body 12 is inserted into the terminal chamber 4 and thereby housed in the terminal chamber 4. A lance receive hole 13*a* is formed on the bottom wall 13. The lance receive hole 13*a* is to be engaged with the above-explained lance 6 formed on the housing 2. The joint terminal 10 is prevented from being pulled out from the terminal chamber 4 due to an engagement of the lance receive hole 13*a* with the pawl of the lance 6.

A pair of a first contact portion 20 and a second contact portion 21 is extended laterally outward from both sides of the terminal body 12, respectively. The first contact portion 20 is bent laterally outward from an upper end of the sidewall 14. The second contact portion 21 is constituted of an upper contact tab 21*a* bent laterally outward from an upper end of the sidewall 15, and a lower contact tab 21*b* extended from an inner upper edge of the first contact portion 20. A height level of the first contact portion 20 is set in a range between a height level of the upper contact tab 21*a* and a height level of the lower contact tab 21*b*. The lower contact tab 21*b* passes through a hole formed on the sidewall 15, so that an end portion of the lower contact tab 21*b* locates just beneath the upper contact tab 21*a*. The upper contact tab 21*a* and the lower contact tab 21*b* are located parallel and a gap is formed between the upper contact tab 21*a* and the lower contact tab 21*b*.

Figure 2:
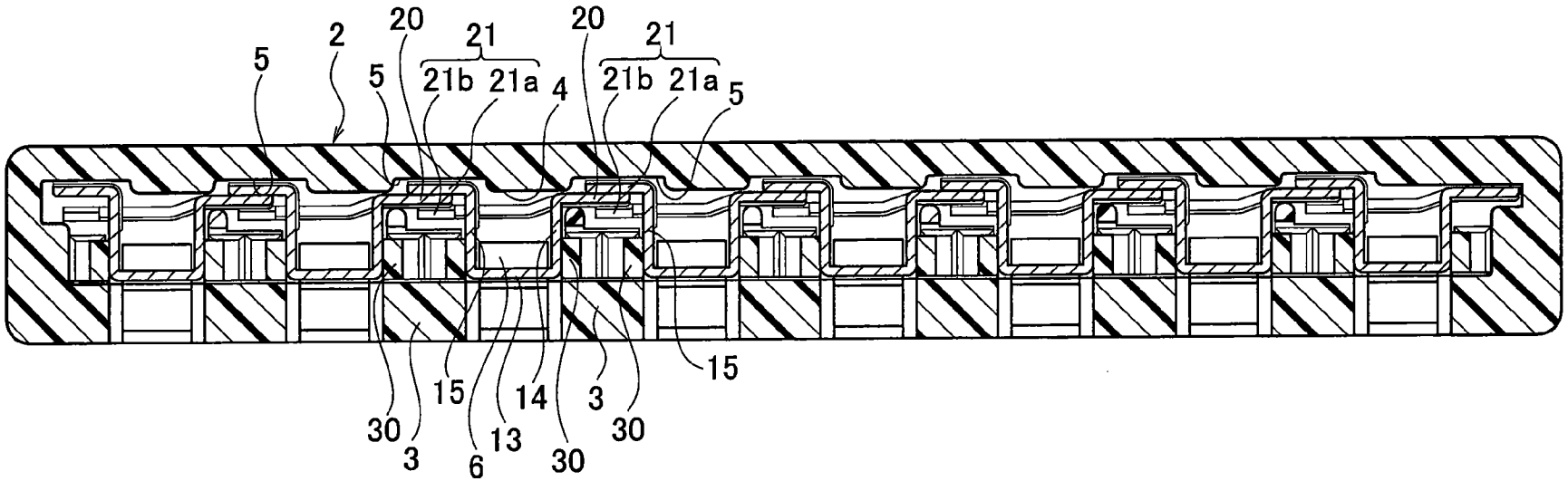
FIG. 2 is a cross-sectional view taken along a line II-II shown in FIG. 1.
Figure 3:
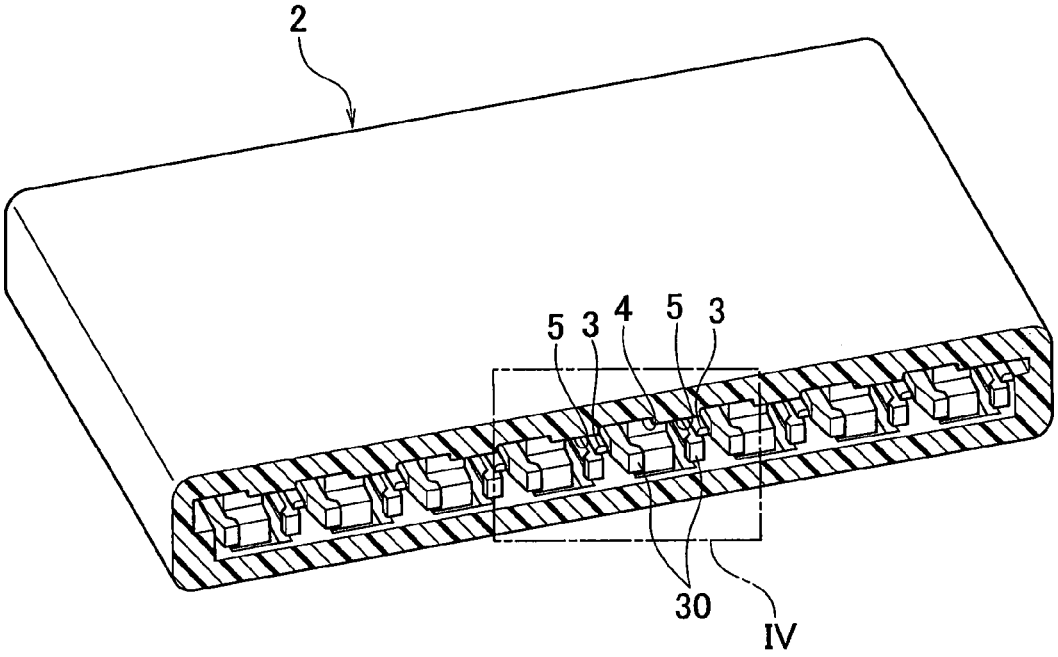
FIG. 3 is a perspective cross-sectional view of the joint connector.
Figure 4:
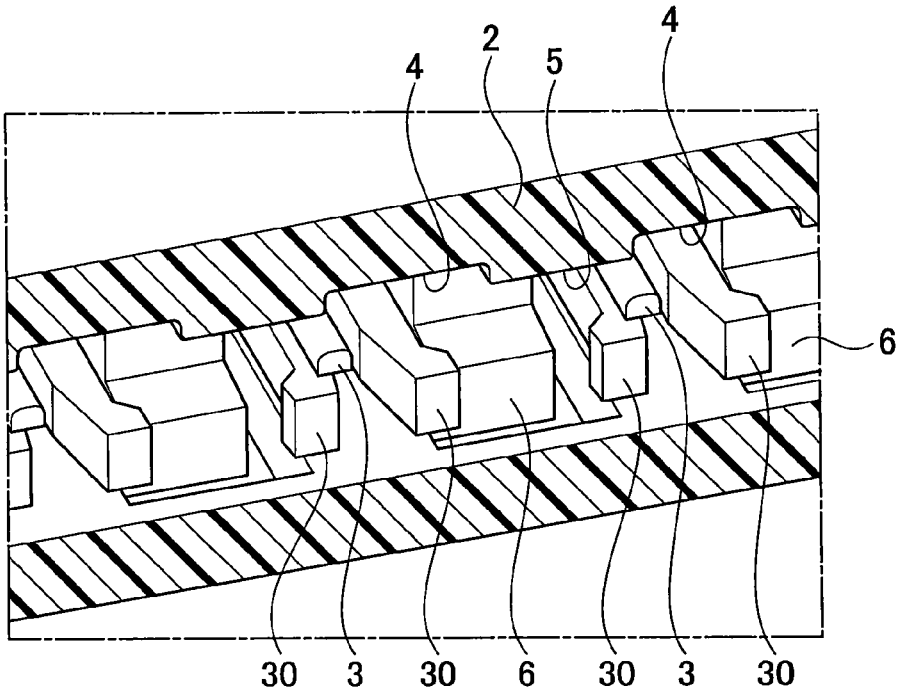
FIG. 4 is an enlarged perspective cross-sectional view of a portion IV shown in FIG. 3.

As shown in FIG. 2, the first contact portion 20 and the second contact portion 21 of the joint terminal 10 are located in the adjacent slits 5, respectively. The first contact portion 20 of a joint terminal 10 is inserted into the gap between the upper contact tab 21*a* and the lower contact tab 21*b* of the second contact portion 21 of a next joint terminal 60 so as to contact with the lower contact tab 21*b* of the second contact portion 21. Therefore, the two joint terminals 10 in the neighboring terminal chambers 4 are electrically contacted with each other.

In addition, the connector housing 2 is provided with pairs of elastically deformable tabs 30. Each of the pairs includes two opposed deformable tabs 30 and provided in each of the terminal chambers 4. Each of the opposed deformable tabs 30 is integrally formed on the partition 3 and has a protrusion at its free end that is protruded toward an inside of the terminal chamber 4 (see FIGS. 4, 6 and 7). Therefore, the free end of one of the opposed deformable tabs 30 contacts with the sidewall 14 of the joint main body 12 by its own elastic restoration behavior (elastic restoration characteristics). Similarly, the free end of another of the opposed deformable tabs 30 contacts with the sidewall 15 of the joint main body 12 by its own elastic restoration behavior. Note that the joint terminal 10 can be inserted into the terminal chamber 4 because the deformable tabs 30 can be elastically deformed.

According to the above-explained configuration, the joint terminal(s) 10 can be prevented from being vibrated when the joint connector 1 is located under a vibrational environment, because the joint terminal 10 is held in the terminal chamber 4 by the deformable tabs 30 contacting with the sidewalls 14 and 15 of the joint terminal 10. In addition, the joint terminal(s) 10 can be located at a constant position in the terminal chamber 4 when clearances between the partitions 3 and the sidewalls 14 and 15 of the terminal body 12 change due to temperature variations, because the changes of the clearances can be compensated by the elastic restoration behavior of the deformable tabs 30.

Therefore, the first contact portion 20 and the second contact portion 21 of the neighboring joint terminals 10 can be stably contacted with each other. In other words, a difference between a thermal distortion of the housing 2 and a thermal distortion of the joint terminal(s) 10 can be compensated by the pairs of the deformable tabs 30. As a result, an increase of a contact resistance to be generated by vibrations and temperature variations can be sufficiently restricted.

Further, each of the deformable tabs 30 is formed integrally with the partitions 3. One end of the deformable tab 30 is a base end that is fixedly connected to the partition 3, and another end of the deformable tab 30 is a free end (that has the protrusion explained above). In other words, the deformable tabs 30 are formed integrally with the partitions 3 so as to have a cantilever structure, respectively, and their free ends are contacted with the sidewalls 14 and 15, respectively. Therefore, the deformable tabs 30 can be provided with no need for additional components.

Furthermore, the second contact portion 21 includes the upper contact tab 21*a* and the lower contact tab 21*b* located parallel and the gap is formed between the upper contact tab 21*a* and the lower contact tab 21*b*. The first contact portion 20 of one of the neighboring joint terminals 10 is wedged into the gap between the upper contact tab 21*a* and the lower contact tab 21*b* of the second contact portion 21 of another of the neighboring joint terminals 10. Here, a total contacting area of the first contact portion 20 and the second contact portion 21 can be made large, and the first contact portion 20 is surely held between the upper contact tab 21*a* and the lower contact tab 21*b* of the second contact portion 21. As a result, the neighboring joint terminals 10 are electrically contacted with each other securely.

Note that the present invention is not limited to the above-explained embodiment. It is not necessary that the joint terminals 10 must be housed in all of the terminal chambers 4. In this case, one group of the joint terminals 10 and another group of the joint terminals 10 may be electrically separated by a hollow terminal chamber(s) 4. But the joint terminals 10 in the one group (or the other group) can be electrically connected with each other.

In the above embodiment, the protrusion is formed at the free end of the deformable tab 30 in order to contact the free end with the joint terminal 10. However, the deformable tab 30 may be formed so as to be slightly inclined toward an inside of the terminal chamber 4 in order to contact the free end with the joint terminal 10.

What is claimed is:

1. A joint connector comprising:

a connector housing that includes a plurality of terminal chambers segmented by a plurality of partitions; and at least two neighboring joint terminals that are housed in terminal chambers neighboring among the plurality of terminal chambers, respectively, wherein each of the neighboring joint terminals includes a wire-crimping portion with which a wire is connected, a terminal body housed in a terminal chamber among the plurality of terminal chambers, and a pair of first and second contact portions laterally extended outward from respective sides of the terminal body, the first contact portion of one of the neighboring joint terminals is electrically contacted with the second contact portion of another of the neighboring joint terminals in a slit that is formed on a partition among the plurality of partitions located between the neighboring joint terminals, the connector housing is provided with pairs of elastically deformable tabs, each of the pairs including two opposed deformable tabs and being provided in each of the plurality of terminal chambers, and the opposed deformable tabs contact with sidewalls of the terminal body of each of the neighboring joint terminals, respectively, by an elastic restoration behavior of the opposed deformable tabs, wherein the second contact portion of each of the neighboring joint terminals includes an upper contact tab and a lower contact tab that are located parallel and a gap is formed between the upper contact tab and the lower contact tab, and the first contact portion of the one of the neighboring joint terminals is wedged into the gap between the upper contact tab and the lower contact tab of the second contact portion of the other of the neighboring joint terminals.

2. The joint connector according to claim 1, wherein the opposed deformable tabs are formed integrally with neighboring partitions among the plurality of partitions so as to have a cantilever structure, respectively, and free ends of the opposed deformable tabs are contacted with the sidewalls, respectively.

3. The joint connector according to claim 1, wherein each of the terminal chambers comprises a lance integrally formed on the connector housing.

4. The joint connector according to claim 3, wherein the lance locks the joint terminal inserted into the terminal chamber to prevent the joint terminal from being pulled out from the terminal chamber.

5. The joint connector according to claim 3, wherein the lances are formed as barbed tabs having pawls protruded from bottoms of the terminal chambers, respectively.

6. The joint connector according to claim 5, wherein the terminal body comprises a bottom wall and a lance receiving hole formed on the bottom wall.

7. The joint connector according to claim 6, wherein the lance receiving hole is configured to be engaged with the lance such that each of the joint terminals is prevented from being pulled out from the terminal chamber due to a respective engagement of the lance receive hole with the pawl of the lance.

8. The joint connector according to claim 1, wherein a height level of the first contact portion is set in a range between a height level of the upper contact tab and a height level of the lower contact tab.

9. The joint connector according to claim 1, wherein the lower contact tab passes through a hole formed on the sidewall, so that an end portion of the lower contact tab locates just beneath the upper contact tab.

10. The joint connector according to claim 1, wherein the opposed deformable tabs contact with the sidewalls of the terminal body of each of the neighboring joint terminals such that the joint terminals are prevented from being vibrated when the joint connector is located under a vibrational environment.

11. The joint connector according to claim 1, wherein the elastic restoration behavior of the opposed deformable tabs locates the joint terminals at a constant position in the terminal chamber to compensate for changes to clearances between the partitions and the sidewalls of the terminal body due to temperature variations.

12. The joint connector according to claim 1, wherein the elastic restoration behavior of the opposed deformable tabs restricts an increase of a contact resistance generated by vibrations and temperature variations.

13. The joint connector according to claim 1, wherein one end of the deformable tab is a base end that is fixedly connected to the partition, and another end of the deformable tab is a free end.

14. The joint connector according to claim 1, wherein the first contact portion of the one of the neighboring joint terminals is wedged into the gap between the upper contact tab and the lower contact tab of the second contact portion of the other of the neighboring joint terminals to increase a total contacting area of the first contact portion and the second contact portion.

15. The joint connector according to claim 1, wherein the first contact portion of the one of the neighboring joint terminals is wedged into the gap between the upper contact tab and the lower contact tab of the second contact portion of the other of the neighboring joint terminals to surely hold the first contact portion between the upper contact tab and the lower contact tab of the second contact portion.

16. The joint connector according to claim 1, wherein the first contact portion of the one of the neighboring joint terminals is wedged into the gap between the upper contact tab and the lower contact tab of the second contact portion of the other of the neighboring joint terminals to provide a secure electrical contact between the neighboring joint terminals.

17. The joint connector according to claim 1, wherein one group of the joint terminals and another group of the joint terminals are electrically separated by a hollow terminal chamber such that the joint terminals in the one group or the other group are electrically connected with each other.

18. The joint connector according to claim 1, wherein a protrusion is formed at a free end of the opposed deformable tab in order to contact the free end with the joint terminal such that the opposed deformable tab is slightly inclined toward an inside of the terminal chamber in order to contact the free end with the joint terminal.

* * * * *